US008684328B2

(12) United States Patent
Mynster

(10) Patent No.: US 8,684,328 B2
(45) Date of Patent: Apr. 1, 2014

(54) UNIVERSAL TROLLING MOTOR MOUNT

(75) Inventor: Richard J. Mynster, Louisburg, KS (US)

(73) Assignee: RM Industries, Inc., Kansas City, MO (US)

( * ) Notice: Subject to any disclaimer, the term of this patent is extended or adjusted under 35 U.S.C. 154(b) by 266 days.

(21) Appl. No.: 12/833,584

(22) Filed: Jul. 9, 2010

(65) Prior Publication Data

US 2012/0006966 A1 Jan. 12, 2012

(51) Int. Cl.
*F16M 1/00* (2006.01)

(52) U.S. Cl.
USPC ..... 248/643; 248/640; 248/231.411; 248/231.51; 440/63; 440/53

(58) Field of Classification Search
USPC ..... 248/640, 641, 642, 643, 154, 228.3, 248/228.4, 231.41, 231.51; 440/53, 55, 63; 280/DIG. 2, 502
See application file for complete search history.

(56) References Cited

U.S. PATENT DOCUMENTS 1,389,712 A * 9/1921 Thompson et al. ..... 440/55
2,131,214 A * 9/1938 Bentz ..... 4/576.1
2,441,000 A * 5/1948 Armstrong ..... 248/642
2,630,991 A * 3/1953 Long ..... 248/596
2,747,893 A * 5/1956 Strand ..... 280/502
2,822,999 A * 2/1958 Tromanhauser ..... 248/642
2,928,630 A * 3/1960 Wisman ..... 248/641
2,928,631 A * 3/1960 Hartman ..... 248/641
2,955,562 A * 10/1960 Walter ..... 440/53
3,814,047 A * 6/1974 Carpenter ..... 440/55
4,371,349 A * 2/1983 Edwards ..... 440/56
4,402,675 A * 9/1983 Eichinger ..... 440/53
4,524,942 A * 6/1985 Kueny ..... 248/643
5,171,174 A * 12/1992 Mynster ..... 440/7
7,972,188 B2 * 7/2011 Bernloehr et al. ..... 440/55

FOREIGN PATENT DOCUMENTS

GB 2032372 A * 5/1980 ..... B63H 21/26

* cited by examiner

*Primary Examiner* — Kimberly Wood
(74) *Attorney, Agent, or Firm* — Lathrop & Gage LLP

(57) ABSTRACT

One trolling motor mount includes a mounting base having a cavity extending therethrough and a motor receiving portion configured to clamp a trolling motor thereon, a bracket, and a lock operably coupled to the base for removably fastening the base to a watercraft. The bracket is pivotably coupled to the base for rotation generally perpendicular to the cavity, and selectively defines a lower edge of the cavity. The bracket is also slidable relative to the base. Another trolling motor mount includes a mounting base having a cavity extending therethrough and a motor receiving portion configured to clamp a trolling motor thereon, a bracket pivotably coupled to the base, and a lock operably coupled to the base for removably fastening the base to a watercraft. The bracket has front and two side surfaces, and at least one channel for allowing the bracket to slide relative to the base.

16 Claims, 7 Drawing Sheets

UNIVERSAL TROLLING MOTOR MOUNT

BACKGROUND

The invention relates generally to mounting apparatus, and more particularly to mounts for transom-mounted trolling motors.

SUMMARY

In one embodiment, a trolling motor mount includes a mounting base, a bracket, and a lock. The mounting base has a cavity extending therethrough and a motor receiving portion configured to clamp a trolling motor thereon. The bracket is pivotably coupled to the mounting base for rotation generally perpendicular to the mounting base cavity. The bracket selectively defines a lower edge of the mounting base cavity, and the bracket is slidable as well as pivotable relative to the mounting base. The lock is operably coupled to the mounting base for removably fastening the mounting base to a watercraft.

In another embodiment, a trolling motor mount includes a mounting base, two locks, and a bracket operably coupled to the mounting base. The mounting base has two side walls, a motor receiving portion for clamping a trolling motor thereon, and a cavity configured to latch on to a side of a watercraft. The cavity extends through and between the two side walls. One of the locks is adjacent each side wall, and the locks are rotatably coupled to the mounting base for removably fastening the mounting base to a watercraft. The locks are rotatable generally perpendicular to each of three interior walls defining the cavity, and the locks are further movable to enter and exit the cavity varying degrees.

In yet another embodiment, a trolling motor mount includes a mounting base, a bracket, and a lock. The mounting base has a cavity extending therethrough and a motor receiving portion configured to clamp a trolling motor thereon. The bracket is pivotably coupled to the mounting base, and the bracket has at least a front surface, two side surfaces, and at least one channel for allowing the bracket to be slidable relative to the mounting base. The lock is operably coupled to the mounting base for removably fastening the mounting base to a watercraft.

BRIEF DESCRIPTION OF THE SEVERAL VIEWS OF THE DRAWINGS

Illustrative embodiments of the present invention are described in detail below with reference to the attached drawing figures, wherein.

DETAILED DESCRIPTION

Figure 1:
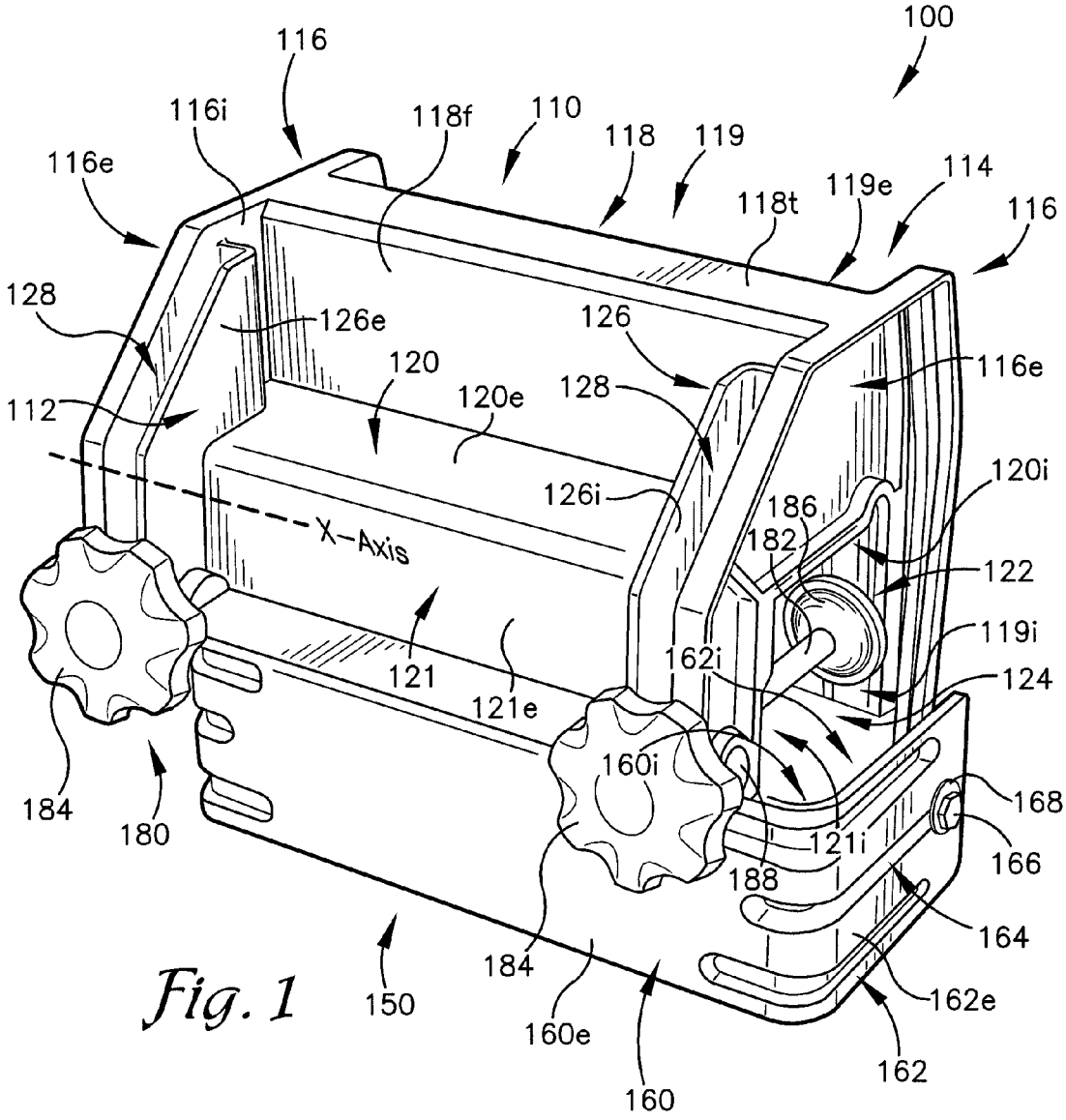
FIG. 1 is a front perspective view of an adjustable mount.

FIGS. 1-7 show one embodiment of an adjustable mount 100 for use in mounting trolling motors 400 on a watercraft 300. As described in more detail below, the adjustable mount 100 includes a mounting base 110, a bracket 150, and at least one lock 180.

As shown in FIG. 1, the mounting base 110 may have an interior surface 112, an exterior surface 114, and two side surfaces 116 on opposite ends of the base 110. The two mounting base side surfaces 116 each have an interior wall 116*i* and an exterior wall 116*e*. The two side surface interior walls 116*i* face each other, while the two side surface exterior walls 116*e* face away from each other.

The mounting base 110 may have two channel surfaces 126 that are adjacent and substantially parallel to the side surfaces 116. Each channel surface 126 has an interior wall 126*i* that faces the side surface interior wall 116*i*, and an exterior wall 126*e* that faces away from the nearest side surface interior wall 116*i*. Channels 128 are formed between the channel surface interior walls 126*i* and the side surface interior walls 116*i*.

Figure 5A:
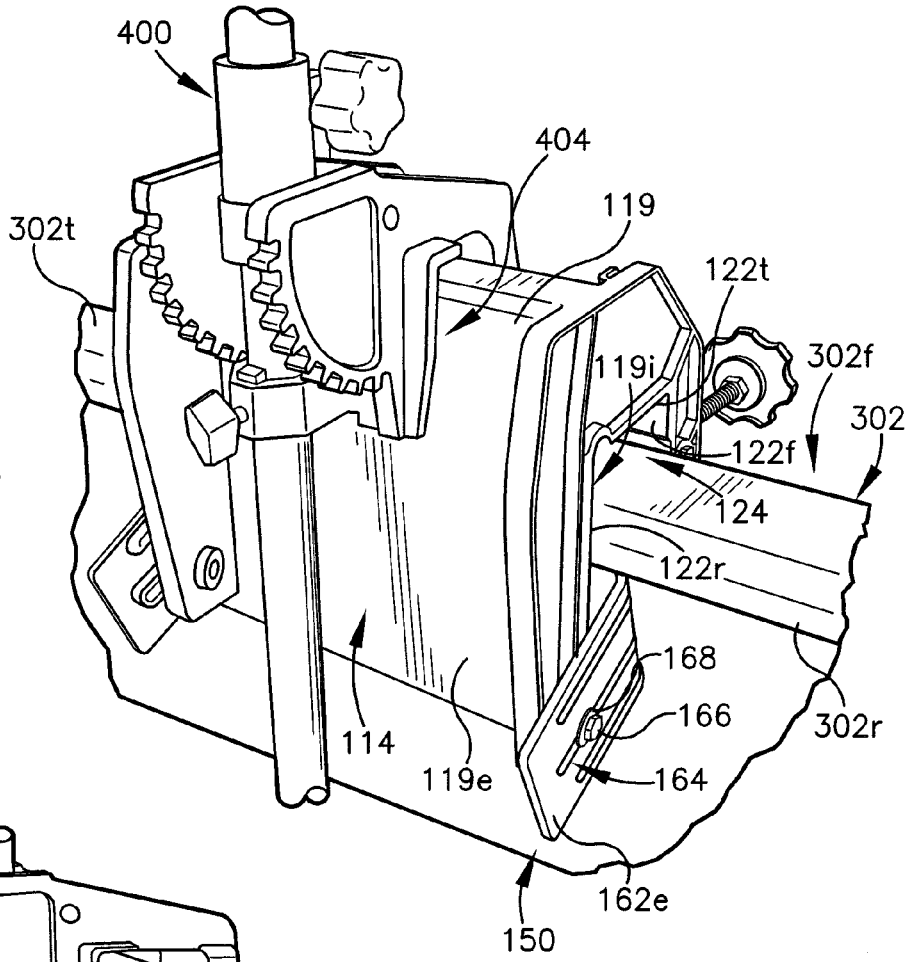
FIG. 5*a* is a rear perspective view of the adjustable mount of FIG. 1, while it is mounted to the watercraft.

The mounting base 110 has a motor receiving portion 118 with a top wall 118*t*, a front wall 118*f*, and a rear surface 119, each of which extend between, and are in contact with the two side surface interior walls 116*i*. The rear surface 119 has an exterior wall 119*e* and an interior wall 119*i* (FIG. 5*a*). The motor receiving portion front wall 118*f* is part of the base interior surface 112, while the motor receiving portion rear surface 119 is part of the base exterior surface 114. The motor receiving portion top wall 118*t* is substantially perpendicular to the motor receiving portion front wall 118*f* and the rear surface exterior wall 119*e*.

The motor receiving portion 118 may have a support surface 120 (FIG. 1) that is part of the base interior surface 112, and that has an exterior wall 120*e* and an interior wall 120*i*. The support surface exterior wall 120*e* lies beneath and is generally perpendicular to the motor receiving portion front wall 118*f*. A small part of the exterior wall 120*e* is in contact with the side surface interior walls 116*i*, while the remaining part of the support surface exterior wall 120*e* is in contact with and terminates at the channel surface exterior wall 126*e*.

The mounting base interior surface 112 may also include a border surface 121 (FIG. 1), which is substantially parallel to the motor receiving portion front wall 118F. The border surface 121 lies beneath and is substantially perpendicular to the motor receiving portion support wall 120, and has an interior wall 121*i* and an exterior wall 121*e*. The border surface exterior wall 121*e* extends between and contacts the channel surface exterior walls 126*e*. Thus, as shown in FIG. 1, the motor receiving portion front wall 118*f*, the support surface exterior wall 120*e*, and the border surface exterior wall 121*e* create a stepped configuration.

A cavity 124 is defined by the interior wall 119*i*, the interior wall 120*i*, and the interior wall 121*i*, and extends through the base side surfaces 116. A groove 122 may further be included, as shown in FIG. 1.

Attention is now directed to the bracket 150 (FIGS. 1 and 5*a* through 6), which has a front surface 160 and two side surfaces 162. The front surface 160 has an interior wall 160*i* and an exterior wall 160*e*, and the side surfaces 162 each have an interior wall 162*i* and an exterior wall 162*e*. The bracket 150 may have two channels 164 that extend through a majority of each side surface 162, and that may extend partway through the front surface 160.

Figure 2:
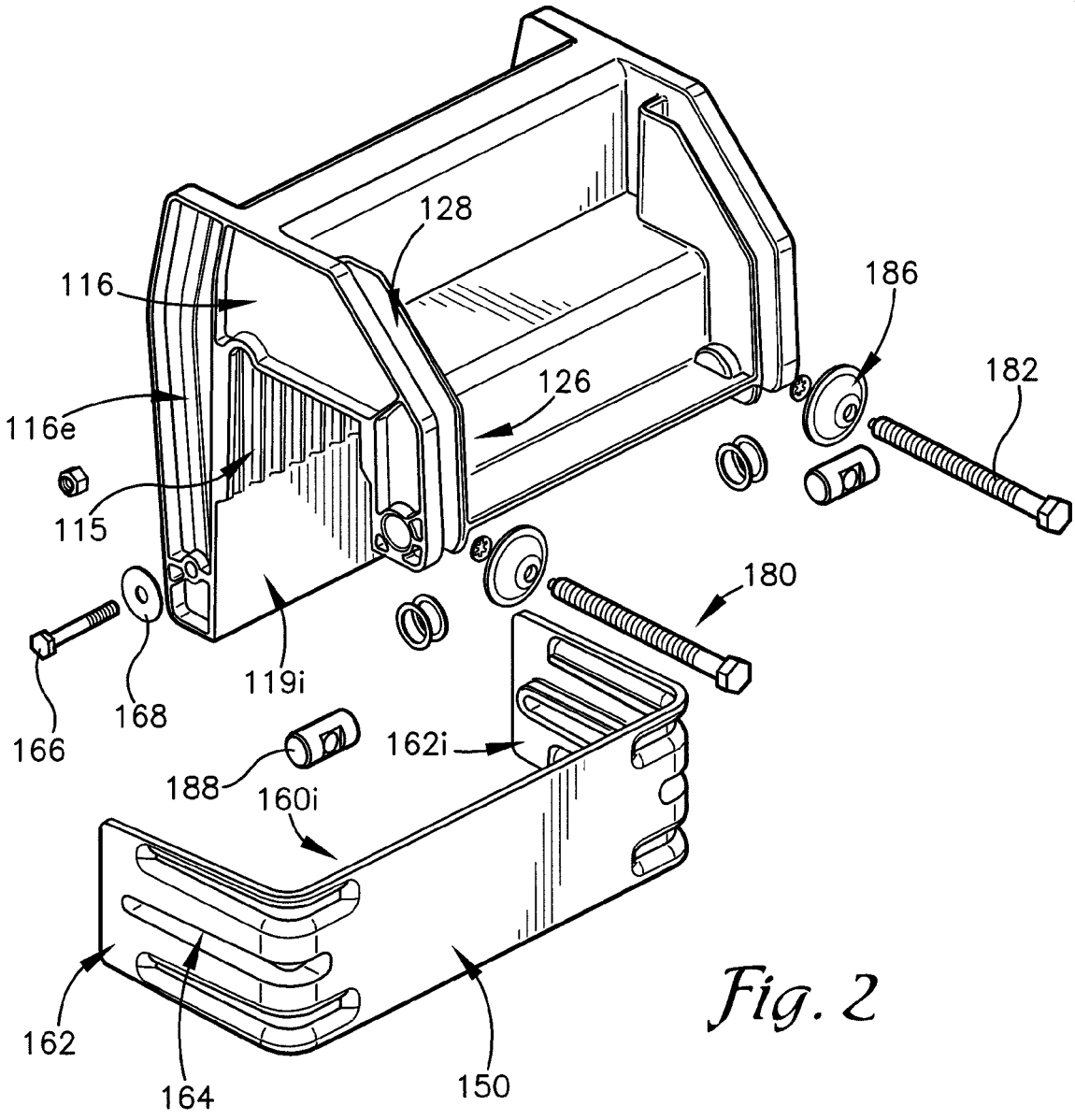
FIG. 2 is an exploded view of the adjustable mount of FIG. 1.

As shown in FIGS. 1-2, the bracket side surfaces 162 are connected to the mounting base side surfaces 116 with bolts 166 which go through the channels 164, such that the bracket side interior wall 162*i* is adjacent and may come into contact with the mount side surface exterior wall 116*e*. The bolts 166 may be used in conjunction with a washer 168 to connect the bracket 150 to the mounting base 110. And, with the bolts 166 being the pivot points, the bracket 150 may be rotatable substantially perpendicular to the X-axis (FIG. 1). Moreover, by virtue of the channels 164, the bracket 150 may be moved forwards or backwards, such that the front surface interior wall 160*i* gets closer to or moves father away from the rear surface interior wall 119*i*. Thus, the bracket 150 is both rotatable around the bolts 166 and movable along the channels 164. As shown in FIG. 1, the front surface 160 and the side surfaces 162 of the bracket 150 may be of unitary construction; however, it is possible for the bracket 150 to not have an extended front surface 160, or for the bracket 150 to have a front surface 160 that is not constructed unitarily with the side surfaces 162. As shown in FIG. 2, the rear surface interior wall 119*i* may have a ripple-like pattern 115, which may enhance the visual appearance of the adjustable mount 100, and also enhance the structural integrity of the mounting base 110.

As shown throughout the drawings, the adjustable mount 100 has two locks 180, though more of fewer locks 180 may also be appropriate. The locks 180 include threaded bolts 182, knobs 184 extending from the bolts 182, and ball and cap joint clamps 186. The knobs 184 can be rotated such that the clamps 186 move closer to or father away from the interior wall 119*i*. In use, an object can be inserted into the cavity 124, and then the clamps 186 can be tightened to ensure that the clamps 186 grip the object firmly. While the locks 180 are shown and described as having threaded bolts 182, knobs 184, and ball and cap clamps 186, those skilled in the art will readily understand that the locks 180 may not include the knobs 184 and may not be threaded, or that the locks 180 may utilize different mechanisms to clamp the object than the threaded bolts 182 or the ball and joint clamps 186.

Threaded bearings 188 (FIGS. 2-3) extend from the base side surfaces 116 through the respective channels 128 and into the respective channel surfaces 126, and are configured to receive the threaded bolts 182. The threaded bolts 182 are connected to the mount 100 by the threaded bearings 188 such that the head of each threaded bolt 182 is to one side of a respective threaded bearing 188, while the clamps 186 are on the other side of the threaded bearings 188. The threaded bearings 188 are rotatable substantially perpendicular to the X-axis (FIG. 1), and so, the threaded bolts 182 may be rotated substantially perpendicular to the X-axis with the threaded bearings 188 as the pivot points. The channels 128 ensure that the threaded bolts 182 can rotate with the threaded bearings 188 unobstructed. Thus, the clamps 186 can be moved closer to or farther away from the interior wall 119 by virtue of the threading of bolts 182, and the clamps 186 can be rotated closer or farther away from the groove top wall 122*t* by virtue of the rotatable threaded bearings 188.

Attention is now specifically directed to the mount 100 in use with a watercraft 300, as shown in FIGS. 3-7. The watercraft 300 includes a side surface 302 having a front wall 302*f*, a top wall 302*t*, and a rear wall 302*r*. The mount 100 is moved towards the watercraft side surface 302 such that the watercraft side surface 302 enters the cavity 124, with the support surface interior wall 120*i* being generally above the watercraft top wall 302*t* (FIG. 3), the border surface interior wall 121*i* being generally in front of the watercraft front wall 302*f* (FIG. 4), and the rear surface interior wall 119*i* being generally behind the watercraft rear wall 302*r* (FIG. 5*a*); in other words, the mounting base interior surface 112 is generally atop the watercraft side 302 or inside the watercraft 300, while the mounting base exterior surface 114 is generally outside the watercraft 300. It is possible for the watercraft top, front, and rear walls 302*t*, 302*f*, 302*r* to align perfectly with the interior walls 120*i*, 121*i*, 119*i* respectively; however, such alignment is not typical.

Figure 3:
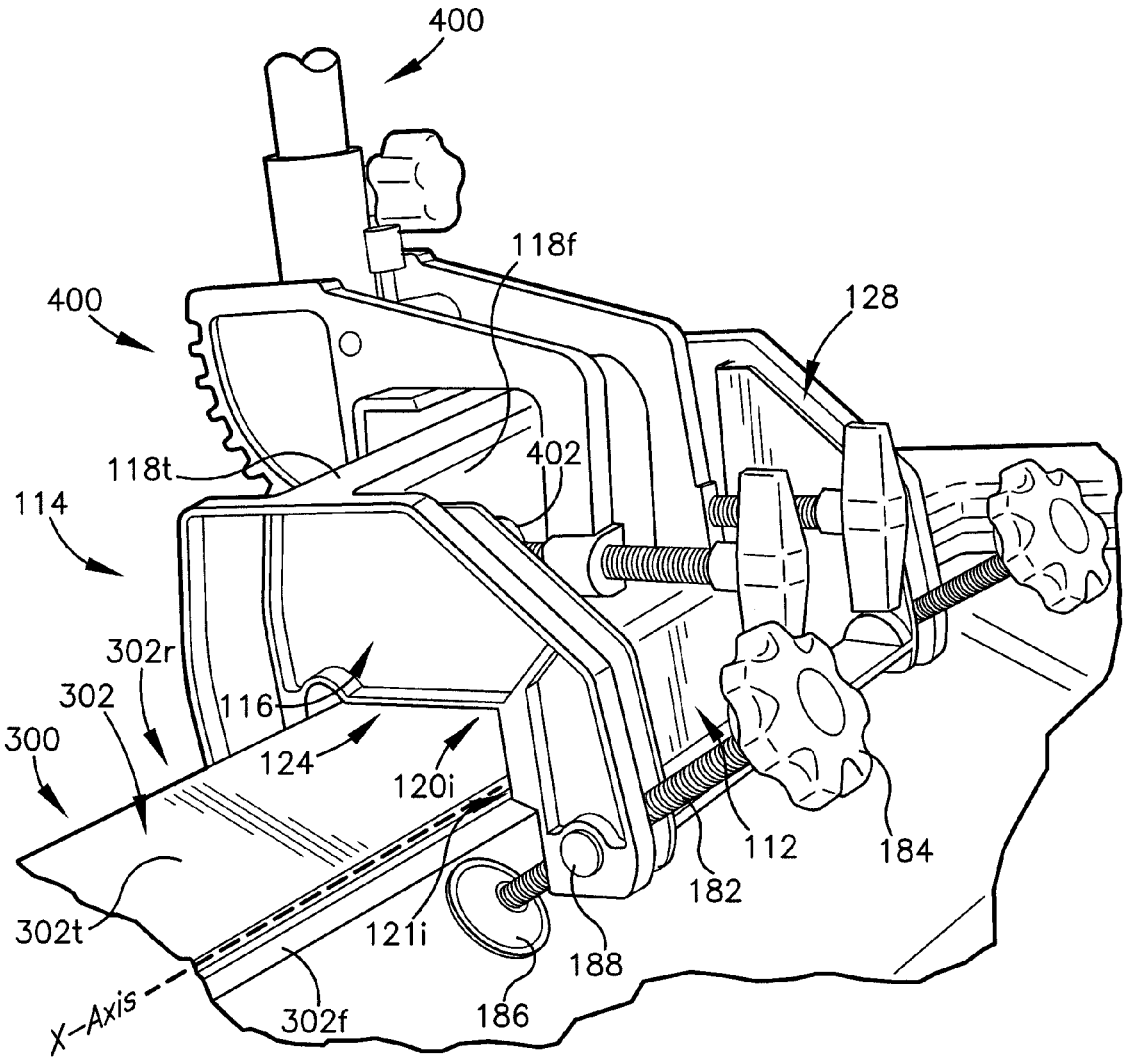
FIG. 3 is a side perspective view of the adjustable mount of FIG. 1, while it is mounted to a watercraft.
Figure 4:
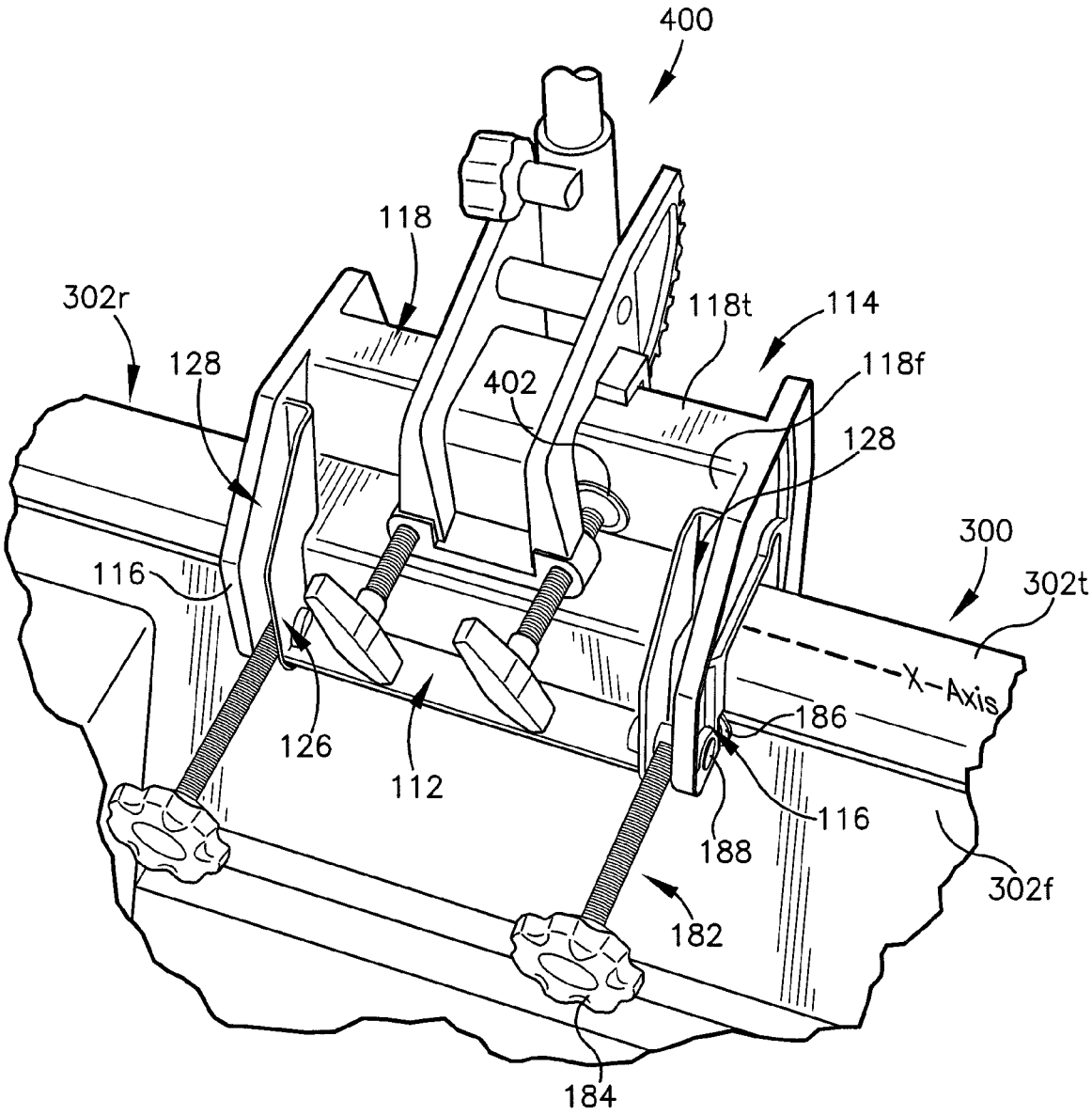
FIG. 4 is another perspective view of the adjustable mount of FIG. 1, while it is mounted to the watercraft.

A trolling motor 400 (FIGS. 3 through 7) may be clamped onto the motor receiving portion 118 with trolling motor clamps 402 (FIG. 4). As can be seen from viewing FIGS. 4 and 5*a* together, the clamps 402 of the trolling motor 400 can be clamped onto the motor receiving portion front wall 118*f* such that a trolling motor rear wall 404 firmly grips the base rear surface exterior wall 119*e*. The trolling motor 400 may also be placed in a stowed position, as shown in FIG. 6, or in an upright position as shown in FIGS. 3-5*b* and 7.

Figure 5B:
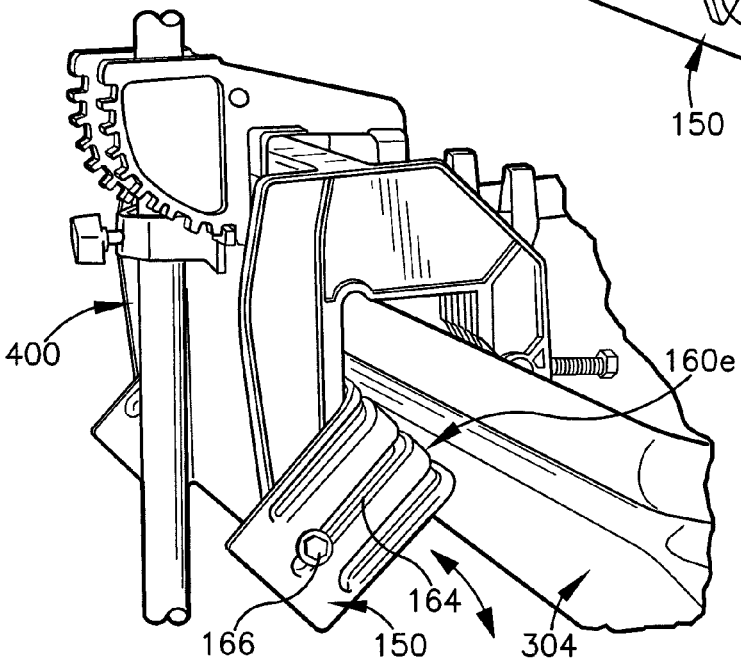
FIG. 5*b* is another side perspective view of the adjustable mount of FIG. 1, while it is mounted to watercraft.
Figure 6:
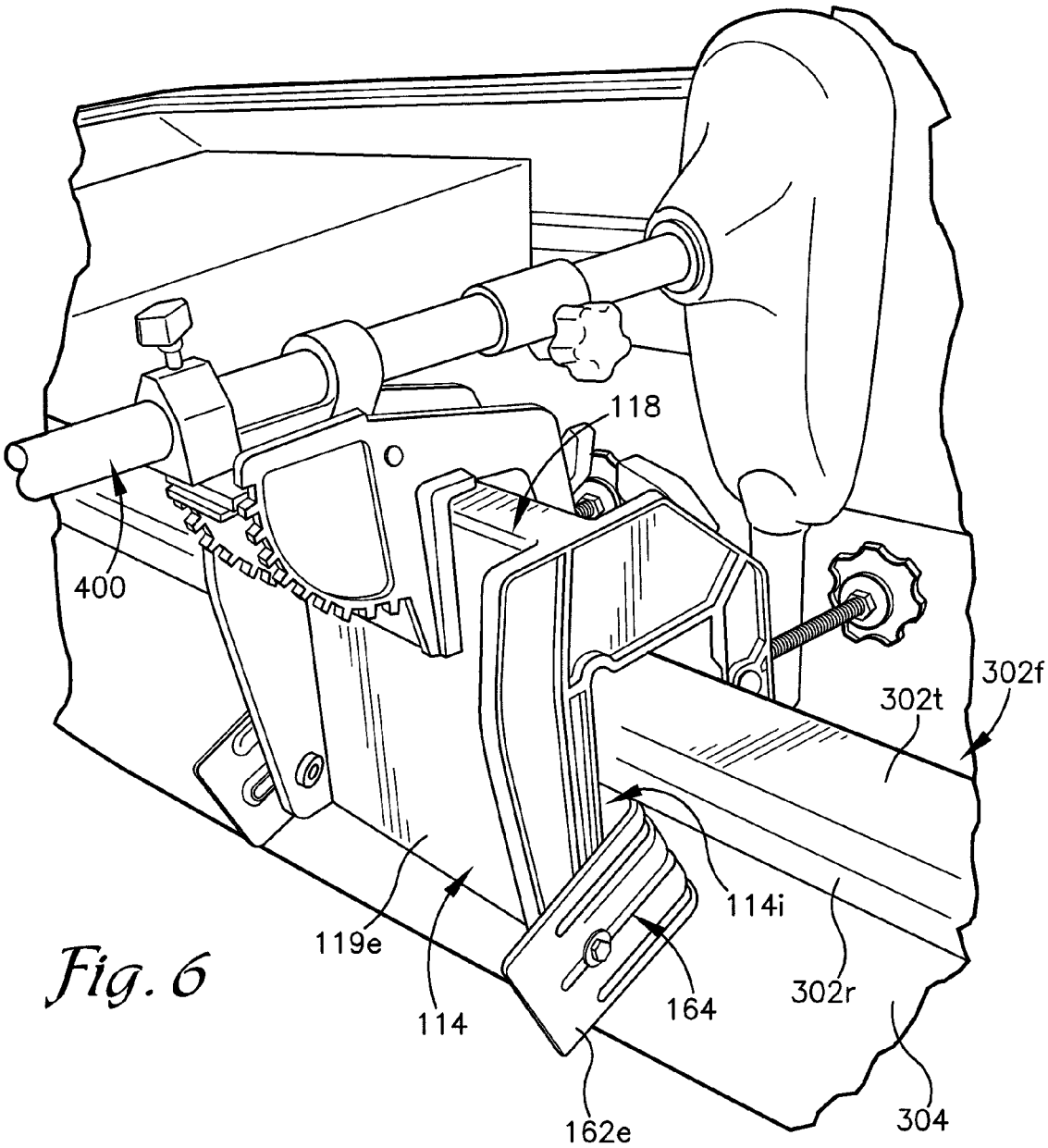
FIG. 6 is another perspective view of the adjustable mount of FIG. 1, wherein a trolling motor attached to the adjustable mount is in a stowed position.
Figure 7:
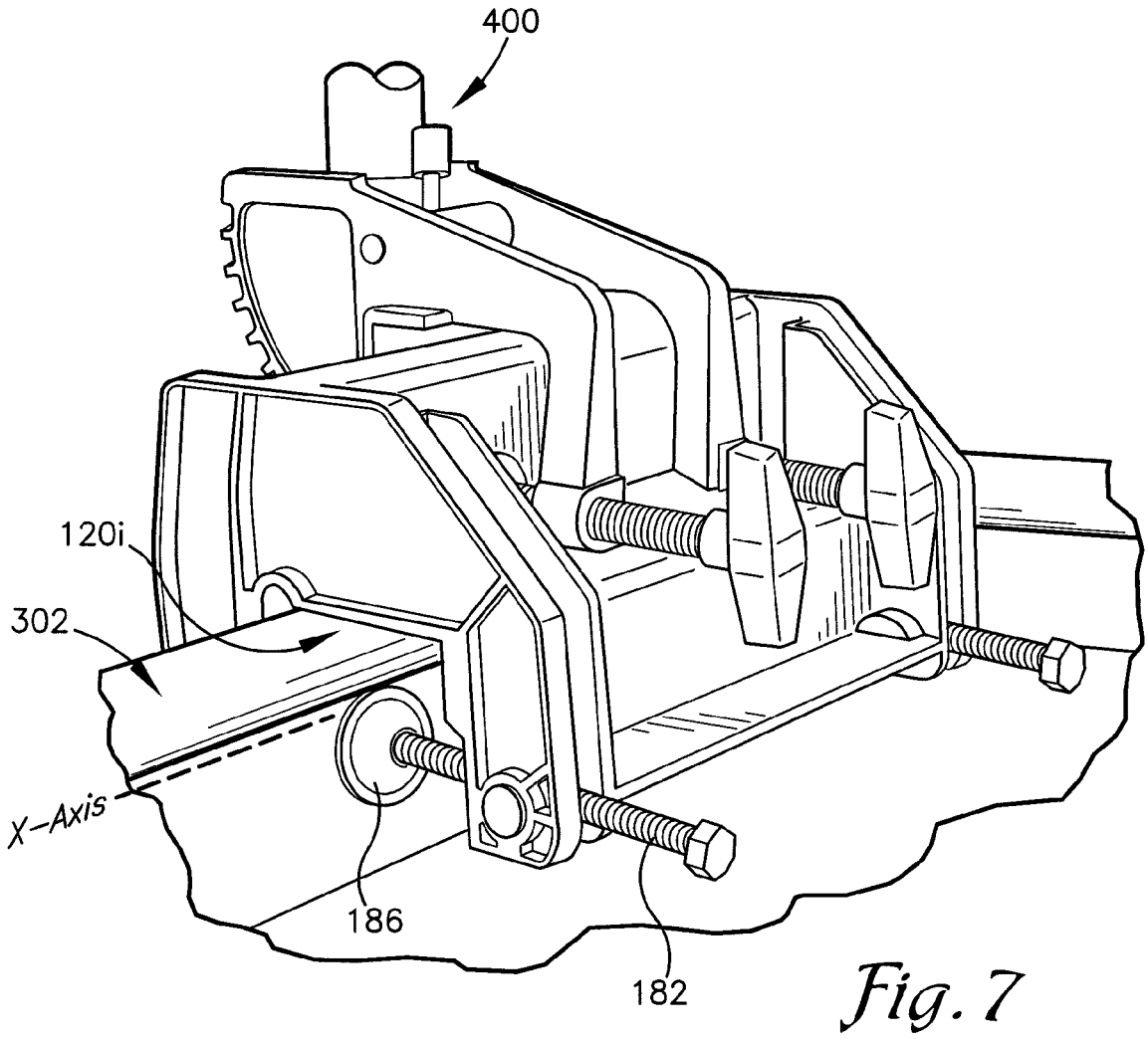
FIG. 7 is another perspective view of the adjustable mount of FIG. 1, wherein the adjustable mount is mounted to a watercraft differently than shown in FIG. 3.

The bracket 150, as shown in FIG. 5*b*, may be rotated around the bolts 166 and moved forwards or backwards along the channels 164 such that all or part of the bracket front surface exterior wall 160*e* comes into contact with and grips a watercraft hull 304. The bolts 166 may then be tightened such that the bracket front surface exterior wall 160*e* tightly grips the watercraft hull 304.

The trolling motor 400, once it is attached to the trolling mount 100 and placed in the operative position, may remain vertical and contact the water at about 90 degrees regardless of which side of the watercraft 300 the mount 100 is attached to. The rotatable bracket 150 can be adjusted to ensure that this positioning is achieved. More particularly, the rotatable bracket 150 can be rotated around the bolts 166, and moved inward and outward along channels 164 such that all or part of the bracket front surface exterior wall 160*e* conforms to the boat hull 304 at any side, or at least firmly grips the boat hull 304 at any side. For example, the mount 100 is attached to a different side surface 302 of the watercraft 300 in FIG. 7 as compared to FIG. 3, as manifested by the different angles at which the mount 100 is gripping the water craft side 302 (compare e.g., the clamps 186 and interior wall 120*i* in FIG. 7, and FIG. 3); however, by virtue of the adjustable bracket 150, the trolling motor 400 may be attached to the mount 100 such that the trolling motor 400 is substantially perpendicular to the water upon contact in both locations.

The clamps 186 (which are initially retracted such that they come close to the threaded bearing 188 and do not obstruct the cavity 124) may be tightened after the bracket 150 is adjusted, such that they clamp on to the watercraft 300 (FIG. 3). As discussed above, by virtue of the rotatable threaded bearing 188, the threaded bolts 182 can be moved perpendicular to the X-axis (FIG. 1) along the channels 128 such that the clamps 186 clamp different parts of the watercraft 300. The clamps 186 can be adjusted along with the bracket 150 to ensure that the trolling motor 400 remains substantially perpendicular to the water upon contact.

In sum, the mount 100 may allow a trolling motor 400 to be attached to different sides of a watercraft 300, including the bow or the stern, regardless of the hull angle, while ensuring that the trolling motor 400 remains substantially perpendicular to the water or as otherwise desired in its operative position.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A trolling motor mount for mounting a trolling motor to a top wall of a hull of a watercraft, the trolling motor mount comprising:

a mounting base having a cavity extending there through for receiving the top wall and including a trolling motor receiving portion with a top wall, a front wall and a rear surface, each of which extend between and are in contact with a first and second side surface interior wall of the mounting base;

a U-shaped bracket with a planar front surface and two side surfaces oppositely disposed on the front surface, the side surfaces including longitudinally extending channels disposed therein, the bracket pivotably coupled to the mounting base through the longitudinally extending channels for rotation generally perpendicular to the mounting base cavity, the bracket disposed at a lower edge of the mounting base cavity, the bracket being slidable as well as pivotable relative to the mounting base for contacting an exterior surface of the hull; and a lock operably coupled to the mounting base for removably fastening the mounting base to the watercraft, the lock operable on an interior surface of the hull wherein the lock includes a pivotable threaded bearing.

2. The trolling motor mount in claim 1, further comprising an additional lock coupled to the mounting base for removably fastening the mounting base to the watercraft.

3. The trolling motor mount in claim 2, wherein each lock is situated adjacent a respective side wall of the mounting base.

4. The trolling motor mount in claim 3, wherein:

each lock comprises: a threaded bolt; a ball and cap joint clamp secured at an end of the threaded bolt; and a threaded bearing with an opening configured to receive the threaded bolt;

the side wall is adjacent another wall such that a channel is formed there between; and the threaded bearing extends through the channel and is rotatable relative to the mounting base.

5. The trolling motor mount in claim 4, wherein the threaded bearing is rotatable generally perpendicular to the mounting base cavity.

6. The trolling motor mount in claim 1, wherein the bracket channels are configured to allow the bracket to slide generally perpendicular to the bracket front surface.

7. The trolling motor mount in claim 6, wherein the bracket is coupled to the mounting base with two bolts passing through the channels, respectively, the bolts extend generally parallel to the mounting base cavity, and the bracket is rotatable about the bracket bolts.

8. The trolling motor mount in claim 7, wherein the lock and the bracket are adjustable to a degree that allows the mounting base to be mounted on different sides of the watercraft, the different sides of the watercraft having different configurations from one another.

9. The trolling motor mount in claim 8, wherein the bracket is of a unitary construction.

10. A trolling motor mount for mounting a trolling motor to the top wall of a hull of a watercraft, the trolling motor mount comprising:

a mounting base having two side walls forming a cavity for receiving the top wall of the hull of the watercraft and a trolling motor receiving portion for receiving the trolling motor, the trolling motor receiving portion further comprising a top wall, a front wall and a rear surface, each of which extend between and are in contact with a first and second side surface interior wall of the mounting base;

at least one lock adjacent each side wall, the lock including at least one of 1) a threaded bolt; 2) a ball and cap joint clamp secured to an end of the threaded bolt; and 3) a threaded bearing with an opening configured to receive the threaded bolt, the at least one lock rotatably coupled to the mounting base for removably fastening the mounting base to the top wall of the watercraft, the locks rotatable generally perpendicular to an interior surface of the hull of the watercraft; and a U-shaped bracket with a planar front surface and two side surfaces oppositely disposed on the front surface, the side surfaces including longitudinally extending channels disposed therein, the bracket pivotably coupled to the mounting base through the longitudinally extending channels, the bracket operably coupled to the mounting base for rotation generally perpendicular to the mounting cavity, the bracket disposed at a lower edge of the mounting base cavity, the bracket being slidable as well as pivotable relative to the mounting base for contacting an exterior surface of the hull.

11. The trolling motor mount in claim 10, wherein the bracket is rotatable about a pivot axis, bracket rotation being generally perpendicular to each of a three interior walls defining the cavity.

12. The trolling motor mount in claim 11, wherein the bracket is slidable about the bracket pivot axis.

13. The trolling motor mount in claim 12, wherein the locks and the bracket are selectively adjustable for allowing vertical orientation of the motor receiving portion to be obtained for various hull angles and watercraft side dimensions.

14. A trolling motor mount for mounting a trolling motor to a hull of a watercraft, the trolling motor mount, comprising:

a mounting base having a cavity extending there through and having a vertically extending motor receiving portion configured to secure a trolling motor thereto, the trolling motor receiving portion further comprising a top wall, a front wall and a rear surface, each of which extend between and are in contact with a first and second side surface interior wall of the mounting base;

a U-shaped bracket with a front surface and two side surfaces, the bracket pivotably coupled to the mounting base and disposed at a lower edge of the mounting base cavity for contacting an exterior surface of the watercraft hull, the bracket having at least one channel for allowing the bracket to be slidable relative to the mounting base; and a lock operably coupled to the mounting base for removably fastening the mounting base to the watercraft, the lock including at least one of 1) a threaded bolt; 2) a ball and cap joint clamp secured to an end of the threaded bolt; and 3) a threaded bearing with an opening configured to receive the threaded bolt, the lock operable on an interior surface of the hull wherein the lock includes a pivotable threaded bearing.

15. The trolling motor mount in claim 14, wherein the bracket is coupled to the mounting base at one side of the cavity and the lock is coupled to the mounting base at an opposite side of the cavity.

16. A trolling motor mount for mounting a trolling motor to an uppermost portion of a hull of a watercraft, the trolling motor mount comprising:

a mounting base having a cavity extending there through for receiving the uppermost portion of the hull and including a trolling motor receiving portion with a top wall, a front wall and a rear surface, each of which extend between and are in contact with a first and second side surface interior wall of the mounting base;

a U-shaped bracket with a front surface and two oppositely disposed side surfaces, the bracket pivotably coupled to the mounting base and disposed at a lower edge of the mounting base cavity, the U-shaped bracket being slidable as well as pivotable relative to the mounting base for contacting an exterior surface of the hull; and a lock operably coupled to the mounting base for removably fastening the mounting base to the watercraft, the lock including at least one of 1) a threaded bolt; 2) a ball and cap joint clamp secured to an end of the threaded bolt; and 3) a threaded bearing with an opening configured to receive the threaded bolt, the lock operable on an interior surface of the hull.

* * * * *